US008677720B2

(12) United States Patent
Carson et al.

(10) Patent No.: US 8,677,720 B2
(45) Date of Patent: Mar. 25, 2014

(54) PRECAST CONCRETE PILE WITH CARBON FIBER REINFORCED GRID

(71) Applicants: John M. Carson, Greenville, SC (US); Sami Rizkalla, Holly Springs, NC (US); Earl Shimp, Jacksonville, FL (US)

(72) Inventors: John M. Carson, Greenville, SC (US); Sami Rizkalla, Holly Springs, NC (US); Earl Shimp, Jacksonville, FL (US)

(73) Assignee: AltusGroup, Inc., Bethlehem, PA (US)

( * ) Notice: Subject to any disclaimer, the term of this patent is extended or adjusted under 35 U.S.C. 154(b) by 0 days.

(21) Appl. No.: 13/652,126

(22) Filed: Oct. 15, 2012

(65) Prior Publication Data

US 2013/0097955 A1 Apr. 25, 2013

Related U.S. Application Data

(60) Provisional application No. 61/547,372, filed on Oct. 14, 2011.

(51) Int. Cl.
*E04C 5/07* (2006.01)
*E04C 5/20* (2006.01)

(52) U.S. Cl.
USPC ..... 52/831; 52/834; 52/782.1; 52/791.1; 52/309.17; 428/36.1; 428/193; 428/408

(58) Field of Classification Search
USPC ..... 52/169.1–169.9, 169.13, 169.14, 170, 52/82, 309.15, 309.16, 309.17, 782.1, 52/DIG. 7, 309.7, 309.8, 309.12, 793.1, 52/791.1, 799.1, 800.11, 801.1, 802.1, 52/834–843, 745.19, 742.13, 745.17; 428/36.3, 120, 188, 288, 320.2, 294.1, 428/908.8, 34.6, 703, 902, 34.4–34.7, 36.1, 428/36.91, 193, 408, 105; 138/172, 138/174–176; 156/71; 264/263, 274, 275, 264/277, 278, 271.1, 279.1, 331.11; 249/117, 144
See application file for complete search history.

(56) References Cited

U.S. PATENT DOCUMENTS

| | | | | |
|---|---|---|---|---|
| 2,080,999 | A * | 5/1937 | Cooney | 138/100 |
| 2,425,079 | A * | 8/1947 | Billig | 52/88 |
| 3,937,372 | A * | 2/1976 | Bode, Jr. | 222/600 |
| 4,494,576 | A * | 1/1985 | Buttner | 138/175 |
| 4,797,037 | A | 1/1989 | Hong | |
| 4,918,891 | A * | 4/1990 | Gerszewski | 52/295 |
| 5,599,599 | A * | 2/1997 | Mirmiran et al. | 428/36.3 |
| 5,836,715 | A | 11/1998 | Hendrix et al. | |
| 6,123,879 | A | 9/2000 | Hendrix et al. | |
| 6,263,629 | B1 | 7/2001 | Brown, Jr. | |
| 6,454,889 | B1 | 9/2002 | Hendrix et al. | |
| 6,632,309 | B1 | 10/2003 | Hendrix et al. | |
| 7,073,980 | B2 | 7/2006 | Merjan et al. | |

* cited by examiner

*Primary Examiner* — Jeanette E. Chapman
(74) *Attorney, Agent, or Firm* — Sheridan Ross P.C.

(57) ABSTRACT

A composite support structure is provided with a plurality of support strands surrounded by a carbon fiber reinforced polymer mesh and surrounded by structural concrete. The support structure provides various advantages in withstanding compressive, tensile, and shear loading.

20 Claims, 5 Drawing Sheets

| | CFRP Pile | Control Pile |
|---|---|---|
| Theoretical Moment Capacity | 612.5 kip-ft | 625 kip-ft |
| Actual Moment Capacity | 776 kip-ft | 759 kip-ft |
| Ratio (Actual/Theoretical) | 1.27 | 1.21 |

PRECAST CONCRETE PILE WITH CARBON FIBER REINFORCED GRID

This application claims the benefit of priority from U.S. Provisional Patent Application 61/547,372, filed Oct. 14, 2011, the entire disclosure of which is incorporated by reference in its entirety.

FIELD OF THE INVENTION

The present invention relates generally to concrete support structures. More specifically, the present invention relates to precast concrete piles with carbon fiber reinforced polymer ("CFRP") elements or a "grid."

BACKGROUND

Concrete support structures and piles are widely used during the construction of various objects and structures. While providing excellent resistance to compression forces, concrete is known to have a comparatively low resistance to tensile forces. Accordingly, concrete may be provided with internal support structures, such as rebar and associated stirrups or spiral ties, particularly where the concrete will be subjected to tensile loading or moment forces.

Steel rebar typically corrodes with exposure to wet and dry cycles, expands in volume, and causes deterioration of associated concrete. This poses risks of serious problems for the pile structures generally, and may require expensive repair and rehabilitation during the service life of the pile and could lead to possible replacement of the piles.

SUMMARY

Accordingly, the present disclosure contemplates a novel system, device, and various methods for providing a CFRP mesh in a concrete structure, such as a pile or support column. In various embodiments, a concrete pile is formed by providing a CFRP mesh wrapped around steel strands or ties disposed in a circular or alternative geometric pattern. Concrete is then provided and poured around the wrapped strands to form a final structure. In alternative embodiments, CFRP is used in conjunction with rebar and other well known construction materials to provide improved strength and durability.

The following references generally related to carbon grids disposed within concrete are hereby incorporated by reference in their entireties: U.S. Pat. No. 5,836,715 to Hendrix et al., U.S. Pat. No. 6,123,879 to Hendrix et al., U.S. Pat. No. 6,263,629 to Brown Jr., U.S. Pat. No. 6,454,889 to Hendrix et al., and U.S. Pat. No. 6,632,309 to Hendrix et al.

CFRP elements provide various advantages including, for example, high levels of corrosion resistance which prevents a pile or similar structure from spalling due to corrosion of the internal steel elements, such as steel spirals. Corrosion resistance provided by CFRP elements therefore extends the life cycle of the element, such as a pile, as well as the maintenance efforts and costs required during the life cycle. Another advantage of CFRP is that CFRP elements are typically faster to install than conventional steel spiral elements, thus allowing for smaller crews, faster casting times, and reduced labor/project costs. CFRP elements are characterized by high tensile strength and low weight, at least in comparison with convention steel strands or rebar.

Piles provided with unique features of the present invention significantly increase the service life of the piles, due to the non-corrosive characteristics of the CFRP grid, for example. The CFRP grid is adapted to fit around prestressing strands with an overlap estimated to be eight inches in a preferred embodiment to achieve the full strength of the CFRP grid. Known steel rebar systems and stirrups cause deterioration of the concrete, spalling of the concrete cover, and reduce the overall capacity of the piles. Replacement cost of the deteriorated piles is very expensive and in some cases could compromise the safety of the supported structures. Devices of the present disclosure enhance the durability and sustainability of piles.

In one embodiment, a plurality of strands is provided in a generally circular arrangement. For example, twenty ½" diameter, low-relaxation strands are provided and arranged in a generally circular or oblong pattern. Alternative geometries such as a square, rectangle, triangle and others may also be implemented depending on the geometry of the pile and anticipated use. The arrangement of strands is then wrapped with a carbon mesh having a first end and a second end where the first end and the second end overlap by approximately 1" to approximately 15". In a preferred embodiment, the carbon wrap is provided with an overlap of approximately 8". The wrapped structure is then surrounded with concrete in a predetermined shape to form a pile of the desired shape and/or size, such as pile having a 24"×24" rectangular cross-section. The overall length of the pile will be determined by the size of the structure it is supporting, type of soil and other factors known to those skilled in the art.

Strands for use in piles of the present invention may be prestressed in various embodiments, creating a pile having prestressed strands, rebar, and/or metal components contained therein. Piles produced in accordance with such embodiments comprise enhanced bonding as between the strand and concrete and further protects the strand from corrosion.

The present invention contemplates various means for introducing CFRP reinforcements in concrete pile structures in order to overcome various complications and prior art references which teach away from or otherwise dictate that CFRP reinforcement would not be appropriate in concrete piles. For example, it is generally perceived that concrete would segregate during casting due to the size of the openings within the CFRP mesh. In order to eliminate or reduce the risk of segregation, a CFRP material was selected having appropriately sized apertures in the mesh. Post-pour and post-loading analysis was conducted on piles of the present invention which revealed minimal amounts of segregation posing no significant structural concerns.

In various embodiments, the carbon fiber epoxy grid comprises a commercial fifty thousand filament two with aperture spacing from approximately 1"×1" to approximately 2.5"×2.5". In various embodiments, the carbon fiber epoxy grid comprises a width of approximately 60 to approximately 120 apertures, and preferably 95 apertures. Epoxies suitable for use in the present invention include, for example, commercially available epoxies such as those developed by Chomarat®.

In various embodiments, a self compacting or approved flowable high slump concrete is used to insure proper consolidation. In preferred embodiments, a size #67 stone or smaller is provided as the aggregate for use in the concrete.

Additionally, it is perceived in the construction industry that carbon fiber and prestressed steel would create a galvanic couple and thereby accelerate corrosion. This is especially true where steel strands and carbon are in direct contact, rendering galvanic corrosion more likely to occur, particularly in aggressive environments. Thus, in at least one embodiment of the present invention, a thin layer of epoxy is provided to bind the carbon fibers in the CFRP mesh and create a coating. For example, an epoxy layer of between approximately 0.05 millimeters and approximately 0.50 millimeters may be provided to decrease the rate of galvanic corrosion. In a preferred embodiment, a CFRP mesh is provided having an epoxy layer of approximately 0.25 millimeters. Alternatively, coating materials such as epoxy and other coatings as will be recognized by one of skill in the art could be used to insulate the carbon fiber and prevent contact with the steel.

A particular advantage of the present invention lies in the amount of overlap provided with the CFRP mesh. That is, an overlap of approximately 8" is preferably provided. Furthermore, a butt joint is provided in the longitudinal direction, the butt joint comprising ties which serve to connect one sheet to another.

In a preferred embodiment, an opening between the transverse and main hoop wires of the grid are in the range of 1½" to 2" to allow flow of the concrete into the core of the pile and provide proper bond to the prestressing strands and the CFRP wires in both directions. The wire in the hoop direction has been proven to provide sufficient confinement similar and in some cases exceeding the confinement provided by the steel welded fabric mesh currently used for conventional piles. The size of the aggregate ranges between ½" to ¾".

In one embodiment, a precast concrete support member is provided, the member comprising a plurality of elongate steel strands each having a first end and a second end, a carbon fiber reinforced polymer mesh having a length and a width, the plurality of elongate steel strands and the carbon fiber reinforced polymer mesh encased in a concrete material, wherein the plurality of elongate steel strands are arranged in a substantially circular pattern, the location of each of said plurality of elongate steel strands generally corresponding to a radius of a circle. Carbon fiber reinforced polymer mesh is wrapped around the substantially circular pattern such that the carbon fiber reinforced polymer mesh forms a substantially circular arrangement coaxial with the substantially circular pattern of the plurality of elongate steel strands, and the plurality of elongate steel strands and the carbon fiber reinforced polymer mesh are provided within the concrete material and the concrete material has a predetermined cross-sectional shape which remains substantially the same over its length, the concrete material having a longitudinal axis generally coaxial with the plurality of elongate steel strands and the carbon fiber reinforced polymer mesh.

The following references, generally related to the field of support structures are hereby incorporated by reference in their entireties: U.S. Pat. No. 4,797,037 to Hong, U.S. Pat. No. 5,599,599 to Mirmiran et al., and U.S. Pat. No. 7,073,980 to Merjan et al.

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Further, the summary of the invention is neither intended nor should it be construed as being representative of the full extent and scope of the present invention. The present invention is set forth in various levels of detail in the summary of the invention, as well as, in the attached drawings and the detailed description of the invention and no limitation as to the scope of the present invention is intended to either the inclusion or non-inclusion of elements, components, etc. in this summary of the invention. Additional aspects of the present invention will become more readily apparent from the detailed description, particularly when taken together with the drawings.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

Figure 1:
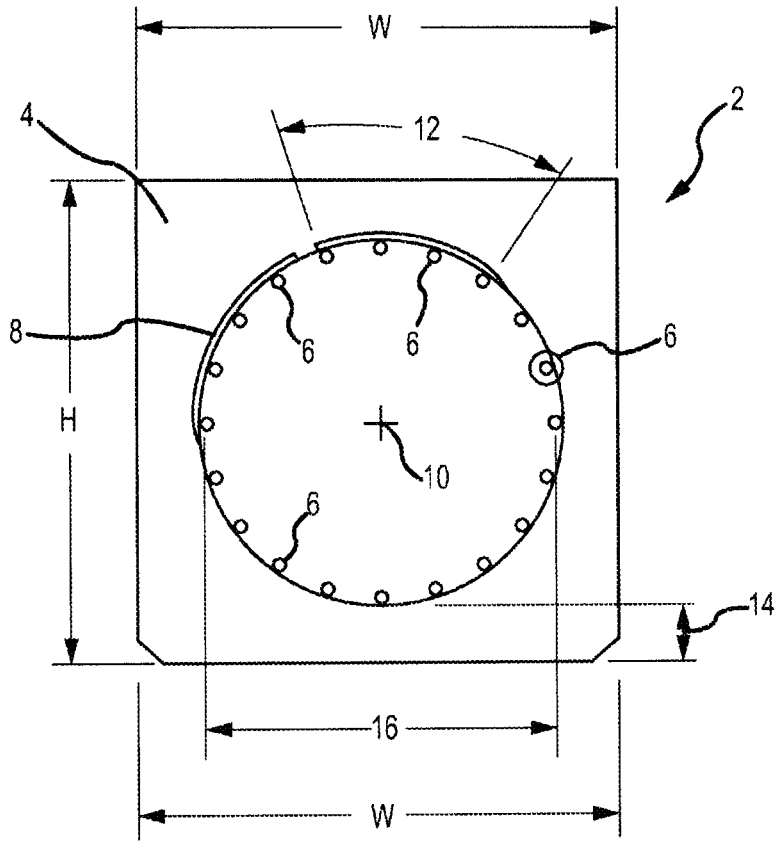
Figure 2:
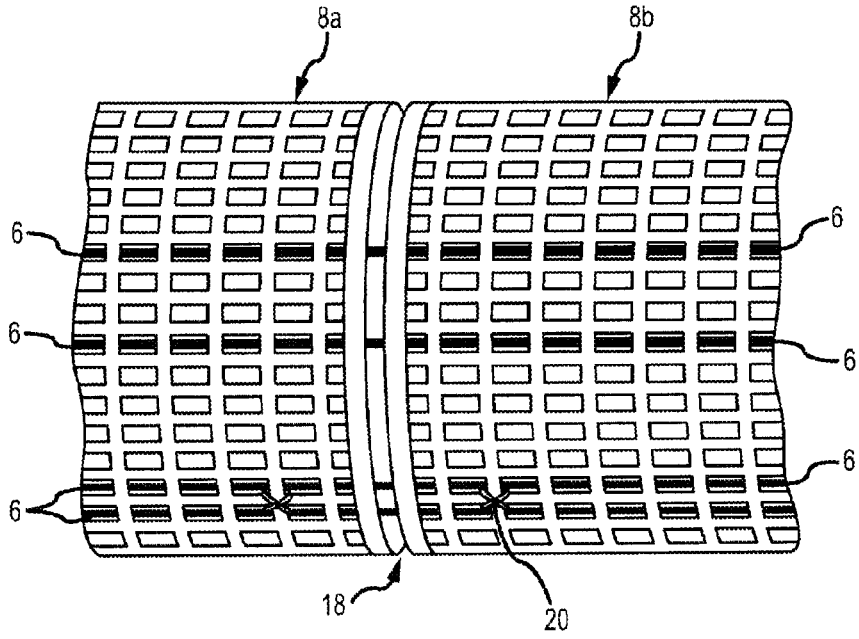
Figure 3:
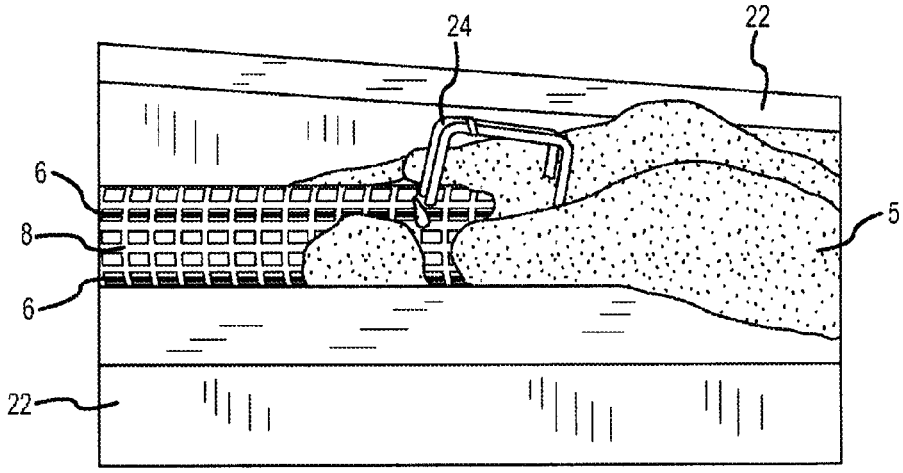
Figure 4:
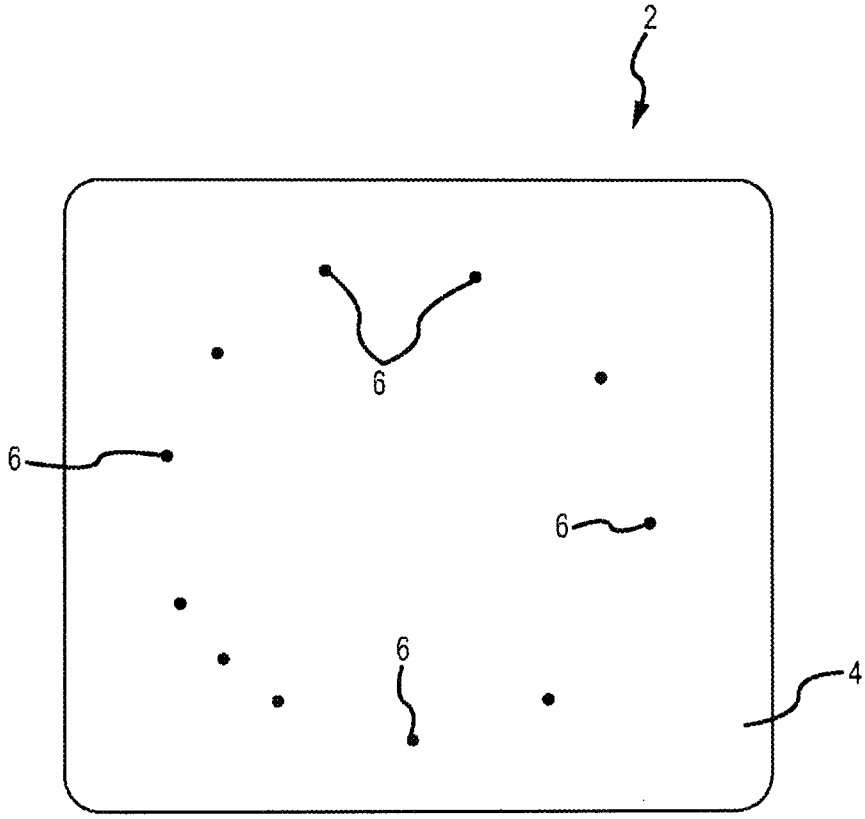
Figures 5, 6:
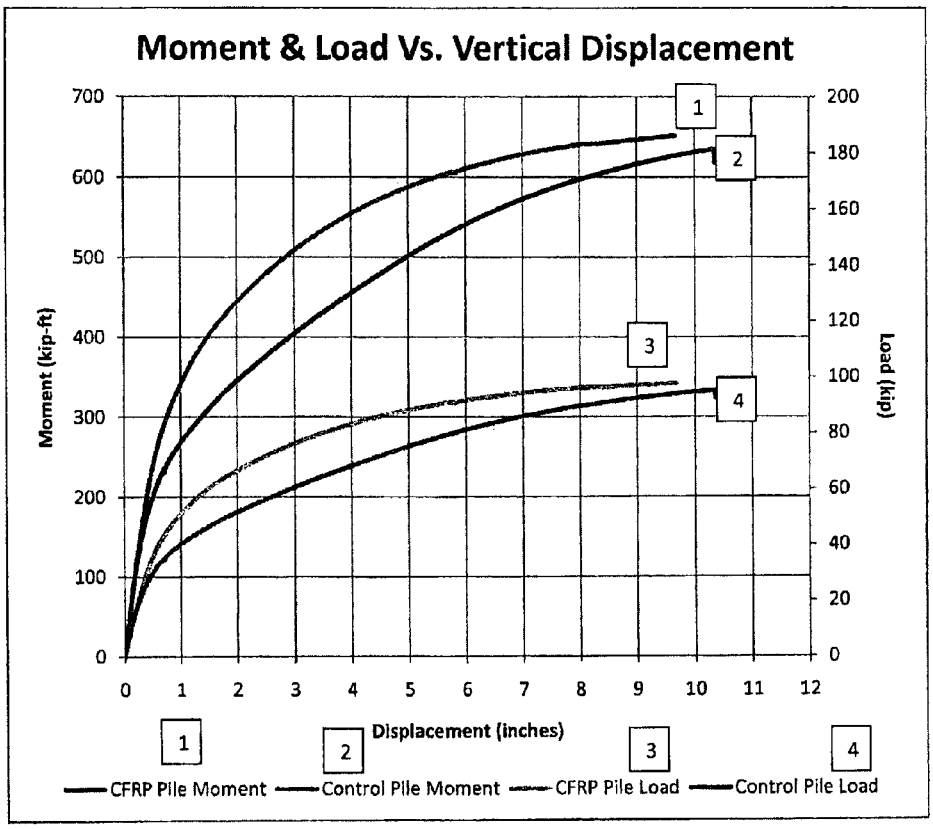

FIG. 1 is a cross-sectional elevation view of a CFRP pile according to one embodiment;

FIG. 2 is a perspective view of a CFRP pile prior to the pouring of concrete according to one embodiment of the invention;

FIG. 3 is a perspective view of a CFRP pile during pouring of concrete according to one embodiment of the invention;

FIG. 4 is an elevation view of one end of a CFRP pile according to one embodiment of the invention;

FIG. 5 is a table providing various empirical data of an embodiment of the present disclosure; and FIG. 6 is a chart showing various empirical data of an embodiment of the present disclosure.

DETAILED DESCRIPTION

The present invention has significant benefits across a broad spectrum of endeavors. It is the applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the arts, can be modified in numerous ways within the scope and spirit of the invention.

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Referring now to FIGS. 1-3, a CFRP pile according to various embodiments of the present invention is shown. It should be understood that the drawings are not necessarily to scale. In certain instances, details that are not necessary for an understanding of the invention or that render other details difficult to perceive may have been omitted from these drawings. It should be understood, of course, that the invention is not limited to the particular embodiments illustrated in the drawings.

FIG. 1 is a cross-sectional view of a CFRP pile 2 according to one embodiment. As shown, a plurality of strands 6 is arranged in a generally circular pattern, the strands 6 comprising steel and a diameter of approximately 0.5". The circular arrangement of strands 6 is covered with a CFRP mesh 8 having approximately an eight inch overlap 12. The diameter 16 of the circular arrangement and CFRP mesh 8 is approximately 18". An outer layer of concrete 4 is provided having a generally rectangular or square cross-section of approximately 24" in height H and 24" in width W. Thus, in at least one embodiment, a minimum casing thickness 14 of approximately 3" of concrete is provided for covering the strand-mesh combination. The pile 2 shown in FIG. 1 may be provided in any variation of lengths and sizes depending on the particular application, soil type, etc. Furthermore, while the embodiment of FIG. 1 depicts a generally rectangular cross-sectional shape, it will be expressly recognized that the present invention is not so limited. Indeed, CFRP piles of various cross-sectional shapes including, but not limited to circular, ovoid, square, rectangular, and various polygonal shapes are contemplated.

A geometric center 10 of the pile 2 is shown. In preferred embodiments, geometric center point 10 comprises a center point for the plurality of strands 6, the mesh 8 and the casing 4, each of said components thus being substantially coaxial. It will be expressly understood, however, that the present disclosure is not limited to such embodiments. Indeed, it is contemplated that various components and features shown and described herein may be situated in various relative positions without deviating from the scope and spirit of the present disclosure.

Additionally, while FIG. 1 depicts 20 strands 6, it will be further recognized that the present disclosure is not limited to any particular number of strands 6. The number and spacing of strands 6 may be varied based on various design considerations and/or preferences.

FIG. 2 is a perspective view depicting strands 6 surrounded by a CFRP mesh 8. As shown, at least two sections of CFRP mesh 8*a*, 8*b* are provided and joined by a butt joint 18. The butt joint 18 is provided in a longitudinal direction to join CFRP mesh portions 8*a*, 8*b* together. CFRP mesh portions 8*a*, 8*b* wrap around elongate strands 6 in a substantially arcuate or circulate manner (see FIG. 1).

Various ties 20 are further be provided to secure the butt joint 18, indicate the location and presence of the butt joint 18 in order to facilitate inspection of the same, and/or secure strands 6 to a surface of the mesh 8*a*, 8*b*. In preferred embodiments, strands 6 are provided proximal or substantially adjacent to the CFRP mesh circumference. In one embodiment, and as depicted in FIG. 2, strands 6 are provided proximal to an interior surface of CFRP mesh portions 8*a*, 8*b*. Strands 6 are preferably held in a preferred location until pouring and curing of concrete by ties 20 and/or securing means provided at one or more ends of the structure to be formed. FIG. 2 depicts one embodiment of the present disclosure wherein a CFRP mesh 8 and associated strands 6 are prepared and ready for receiving a quantity of concrete for forming a pile structure.

FIG. 3 is a perspective view of a CFRP mesh 8 structure during pouring of a concrete mix 5. As shown, a CFRP mesh 8 is positioned in a generally horizontal manner and within a mold structure 22 for receiving a quantity of concrete mix or slurry 5. Preferably, the CFRP mesh 8 is suspended, centered, or otherwise appropriately positioned within the mold 22 such that pouring of concrete 5 results in the CFRP mesh 8 being disposed centrally within the resulting pile (see FIG. 1). In various embodiments, a CFRP pile is positioned vertically and concrete poured therein. Accordingly, various methods for forming a CFRP pile are contemplated. In one embodiment, a method is contemplated wherein a plurality of strands 6 are provided, the plurality of strands 6 surrounded with or by a CFRP mesh 8, the CFRP mesh/strand combination appropriately positioned within a concrete-receiving mold structure 22, and a predetermined quantity of concrete 5 provided, forming a final structure having a cross-sectional shape generally corresponding to the internal dimensions of the mold.

In order to center the CFRP mesh and strands within a form 22, members may be tied or clamped securely to prestressing strands and/or positioned appropriately with respect to the form. For example, the CFRP grid may be tied securely to the prestressing strands which pass through holes which are accurately located at the two end blocks of the prestressing bed and are centered with the cross-section of the piles. In some embodiments, strands 6 may extend beyond a mold or concrete volume to be poured. In such embodiments, the strands 6 and associated CFRP grid 8 may be centered and secured by various support features while the concrete is poured and cured. Once the concrete is poured and hardened, excess strands (i.e. that which extends beyond the pile) may be cut to the appropriate length and/or rendered flush with an end of the pile. Support means 24 are provided in various embodiments to assist in manipulation or stabilization of the CFRP mesh 8 and corresponding strands 6.

FIG. 4 is an elevation view of one end of a CFRP pile 2 after the concrete 4 has been poured and cured. As shown, the pile 2 has a generally rectangular cross-section. While preferred embodiments of the present disclosure comprise square or rectangular cross-sections, it will be expressly recognized that the present disclosure is not limited to any particular cross-sectional shape. Indeed, piles of various cross-sectional shapes are contemplated as being within the scope and spirit of the present disclosure including, but not limited to circular, hexagonal, and octagonal shapes, to name a few. Locations of strands 6, which are encased within the concrete form 4 and wrapped in a CFRP mesh (not shown), are indicated. Depending on the relative lengths of the strands 6 and concrete 4, the termini of the strands may or may not be visible at one or more ends of the pile 2. Accordingly, FIG. 4 should not necessarily be viewed as showing strands 6 protruding through one end of the pile 2. Rather, FIG. 4 is provided to assist with the understanding of the present disclosure and generally indicate the relative spacing and orientation of strands disposed within a concrete pile 4 according to one embodiment. It will further be understood that the present disclosure is not limited to any particular number of strands 6, as previously stated.

Various embodiments of the present disclosure have shown distinct advantages over known devices. Specifically, and as shown in FIG. 5, a CFRP pile in accordance with the disclosure of FIG. 1 resulted in a moment capacity of approximately 776 kip-feet. This particular result is significantly higher than both the theoretical capacity and the capacity of a known or "control" pile. The device has also shown significant enhancements in resisting strain. FIG. 6 provides moment vs. vertical displacement, and load vs. vertical displacement data for a CFRP pile in accordance with the present disclosure and compared with a prior art or "control" pile. As shown, the CFRP pile in accordance with the present disclosure incurred less strain or displacement than a known pile under the same moment and load forces. The control pile provided comprises a known pile with reinforcing members, but devoid of a CFRP grid as shown and described herein.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A composite structural support member comprising:

a plurality of elongate steel strands each having a first end and a second end, said first ends and said second ends arranged in a substantially circular pattern and being substantially parallel to one another along a longitudinal axis;

a carbon fiber reinforced polymer mesh comprising a plurality of apertures, a first end, and a second end;

wherein the mesh is wrapped around said plurality of elongate steel strands, in a substantially circular arrangement coaxial with the substantially circular pattern, wherein said first end of said mesh overlaps said second end of said mesh by at least approximately eight inches along the circumference of the circular pattern; and said plurality of elongate steel strands and said carbon fiber reinforced polymer encased within a concrete material having a preferred cross-sectional shape wherein at least some of said concrete material flows through said plurality of apertures in the carbon fiber reinforced polymer mesh.

2. The composite structural support of claim 1, wherein said support member has a substantially rectangular cross-sectional perimeter shape.

3. The composite structural support of claim 2, wherein said support member has a width of between about 12-48 inches.

4. The composite structural support of claim 1, wherein said plurality of elongate steel strands comprises twenty low-relaxation strands having a diameter between about 0.5-3.0 inches.

5. The composite structural support of claim 1, wherein said carbon fiber reinforced polymer comprises an epoxy layer.

6. The composite structural support of claim 5, wherein said epoxy layer has a thickness between approximately 0.1 and 0.3 millimeters.

7. The composite structural support of claim 1, wherein the carbon fiber reinforced polymer mesh has a thickness of between approximately 1.5 inches and approximately 2.5 inches.

8. The composite structural support of claim 1, wherein at least two carbon fiber reinforced polymer mesh structures are provided and joined by a butt joint.

9. A method of forming a composite structural support member, comprising:

providing a plurality of elongate steel strands arranged in a predetermined pattern and being substantially parallel to one another along a longitudinal axis;

interconnecting said plurality of elongate steel strands with a carbon fiber reinforced polymer mesh having a plurality of apertures;

positioning the mesh and the interconnected strands in a generally horizontal manner within a mold structure for receiving a quantity of concrete such that the mesh is provided in a predetermined position within the mold; and pouring a quantity of concrete around the carbon reinforced polymer mesh wherein at least some of said quantity of concrete flows through said plurality of apertures in the carbon fiber reinforced polymer mesh.

10. The method of claim 9, wherein the plurality of elongate steel strands are provided in a substantially circular arrangement, and the carbon reinforced polymer mesh substantially corresponds to a circumference of the substantially circular arrangement.

11. The method of claim 9, wherein said carbon reinforced polymer mesh is maintained in a central position with respect to said quantity of concrete, creating a composite structural member with a substantially symmetrical cross-section.

12. The method of claim 9, wherein the quantity of concrete is poured around the circumference of said carbon reinforced polymer mesh in a substantially symmetrical arrangement.

13. A precast concrete support member comprising:

a plurality of elongate steel strands each having a first end and a second end;

a carbon fiber reinforced polymer mesh having a length, a width, and a plurality of apertures;

said plurality of elongate steel strands and said carbon fiber reinforced polymer mesh encased in a concrete material;

wherein said concrete material is provided through said plurality of apertures;

wherein said plurality of elongate steel strands are arranged in a substantially circular pattern, the location of each of said plurality of elongate steel strands generally corresponding to a radius of a circle;

wherein said carbon fiber reinforced polymer mesh is wrapped around said substantially circular pattern such that said carbon fiber reinforced polymer mesh forms a substantially circular arrangement coaxial with said substantially circular pattern of said plurality of elongate steel strands, and said substantially circular pattern comprising an arcuate overlap of approximately eight inches along a circumference of the substantially circular pattern; and wherein said plurality of elongate steel strands and said carbon fiber reinforced polymer mesh is provided within said concrete material and said concrete material has a predetermined cross-sectional shape which remains substantially the same over its length, said concrete material having a longitudinal axis generally coaxial with said plurality of elongate steel strands and said carbon fiber reinforced polymer mesh.

14. The precast concrete support member of claim 13, wherein said width of said carbon fiber reinforced polymer mesh is wrapped around said plurality of elongate steel strands such that a first end of said width overlaps a second of said width by at least twelve inches.

15. The composite structural support of claim 13, wherein said precast concrete support member has a substantially rectangular cross-sectional shape.

16. The precast concrete support member of claim 13, wherein said precast concrete support member has a width of between about 12-48 inches.

17. The precast concrete support member of claim 13, wherein said plurality of elongate steel strands comprises twenty low-relaxation strands having a diameter between about 0.5-3.0 inches.

18. The precast concrete support member of claim 13, wherein said carbon fiber reinforced polymer further comprises an epoxy layer.

19. The precast concrete support member of claim 13, wherein said plurality of apertures has a width of between about 1-2.5 inches and a height of between about 1-2.5 inches.

20. The precast concrete support member of claim 13, wherein said carbon reinforced polymer mesh has a width comprising 60-120 apertures.

* * * * *